US005183952A

United States Patent [19]

Morales

[11] Patent Number: 5,183,952

[45] Date of Patent: Feb. 2, 1993

[54] REVOLVER HAND GRIP

[76] Inventor: Francisco J. Morales, 758 Silver La., East Hartford, Conn. 06118

[21] Appl. No.: 687,183

[22] Filed: Apr. 18, 1991

[51] Int. Cl.[5] ..... F41C 23/10

[52] U.S. Cl. ..... 42/71.02; 42/72

[58] Field of Search ..... 42/71.02, 7, 74, 72

[56] References Cited

U.S. PATENT DOCUMENTS

| | | | |
|---|---|---|---|
| 319,020 | 6/1885 | Piffard | 42/71.02 |
| 1,898,378 | 2/1933 | Hess et al. | 42/71.02 |
| 4,286,401 | 9/1981 | Pachmayer et al. | 42/71.02 |
| 4,689,908 | 9/1987 | McClellan | 42/71.02 |
| 4,936,036 | 6/1990 | Sniezak et al. | 42/71.02 |

*Primary Examiner*—Michael J. Carone
*Attorney, Agent, or Firm*—Robert S. Smith

[57] ABSTRACT

A revolver or a hand grip for an associated revolver which includes first and second clam shell shaped portions disposed in nested relationship. One of the portions may include a tang dimensioned and configured to engage the hand of the user intermediate the thumb and forefinger. The apparatus may include a third clam shell portion that is substantially the same as the one portion except that the third portion does not include a tang.

7 Claims, 2 Drawing Sheets

REVOLVER HAND GRIP

BACKGROUND OF THE INVENTION

The invention relates to hand grips for handguns and particularly to hand grips for revolvers.

The prior art includes a large number of hand grips for handguns. It is known to provide semi-automatic handguns with a hand grips that include a so called beaver tail member that extends generally rearwardly. Typically, the beaver tail member is intended to engage the hand at the web of the shooter intermediate the thumb and forefinger. This has the advantage of stabilizing the semi-automatic handgun so that the shooter is able to fire shots more rapidly while still holding the handgun on a target. More particularly, the beaver tail helps to transfer part of the energy inherent in the recoil of the handgun firing to the hand of the shooter. Thus, the shooter is able to control the handgun more precisely at all times. This enables the user to fire more rapidly and accurately. In addition, this construction minimizes trauma, such as bruising to the web of the hand between the thumb and the forefinger.

In semi-automatic handguns the beaver tail member has typically been attached to the semi-automatic handgun by pins that extend through the frame of the semi-automatic handgun. More particularly, the pins extend through existing holes in the frame of the semi-automatic handgun.

These substantial advantages have not been available in revolvers because, in part, of the difficulty of providing a sufficient strong mounting that will not break. It will be understood that the conventional revolver handgun grip is manufactured in two pieces. Namely a left and right portion. This complicates adding a strong beaver tail member to revolver because the attachment to two separate members is not easy to achieve because of the substantial forces involved. It will be understood that the beaver tail will have particular application to very powerful revolvers such as the 44 magnum and the 45 magnum. Even 22 caliber revolvers can, however, be gripped in a manner that will enable more accurate shooting.

It is not feasible to attach the beaver tail to discrete left and right hand portions of a handgrip, particularly because of the difficulty of attaching the beaver tail shaped member to the frame of the revolver or the structure of the existing revolver.

The prior art includes the structures shown in the following U.S. Pat. Nos. 3,672,084; 4,359,833; 4,128,957; and 4,148,149.

These patents are all of only background interest because they do not show the beaver tail construction.

It is an object of the invention to provide a handgrip for a revolver that is very strong.

It is an object of the invention to provide apparatus which is inexpensive to manufacture and to manufacture as well as requires a minimum of labor to install.

Still another object of the invention is to provide a beaver tail hand grip for a revolver for a handgun that will enable the user to hold the handgun on target during firing even in the case of very powerful weapons such as the 44 or 45 magnum.

It is an object of the present invention to provide a hand grip suitable for a revolver that is easily installed on existing revolvers and thus can easily be installed on the existing revolvers.

SUMMARY OF THE INVENTION

It has now been found that these and other objects of the invention may be attained in a revolver or a hand grip for an associated revolver which includes first and second clam shell shaped portions.

In some form of the invention the first and second clam shell shaped portions are disposed in nested relationship. One of the portions may include a tang dimensioned and configured to engage the hand of the user at the web intermediate the thumb and forefinger. The apparatus may include a third clam shell portion that is substantially the same as the one portion except that the third portion does not include a tang.

One of the portions may include a lip against which the other butts against.

BRIEF DESCRIPTION OF THE DRAWING

The invention will be better understood by reference to the accompanying drawing in which.

DESCRIPTION OF THE PREFERRED EMBODIMENT

Figure 1:
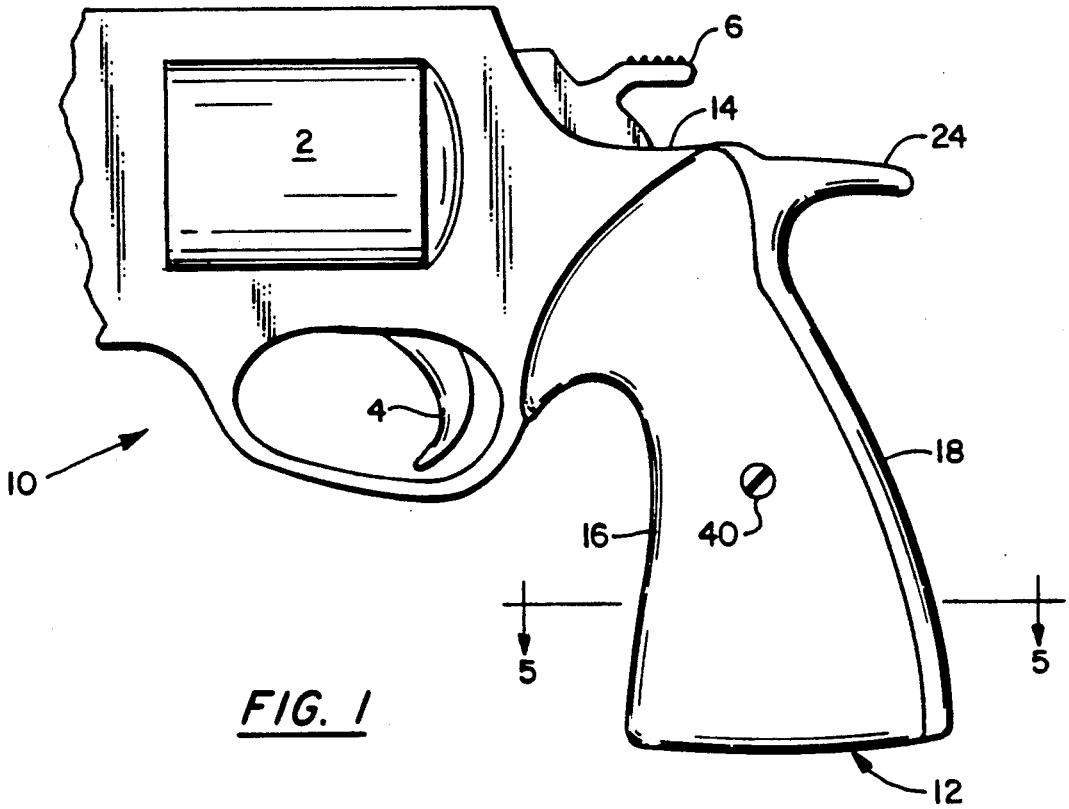
FIG. 1 is a fragmentary side elevational view of a revolver equipped with a handgrip in accordance with one form of the invention.
Figure 2:
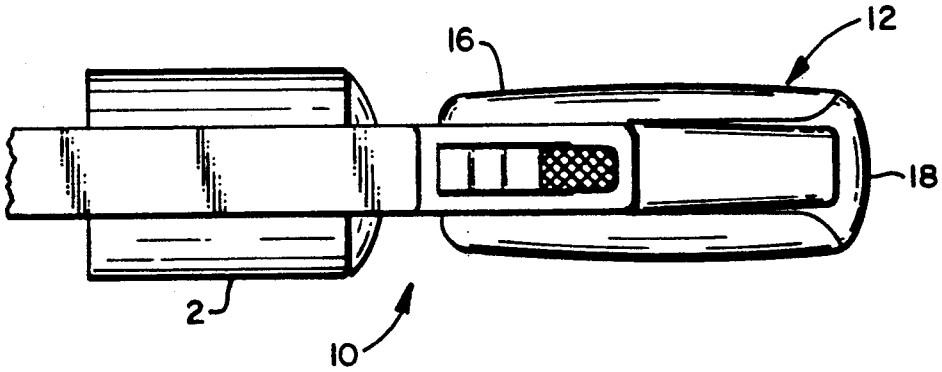
FIG. 2 is a fragmentary plan view of the revolver and handgrip shown in FIG. 1.
Figure 3:
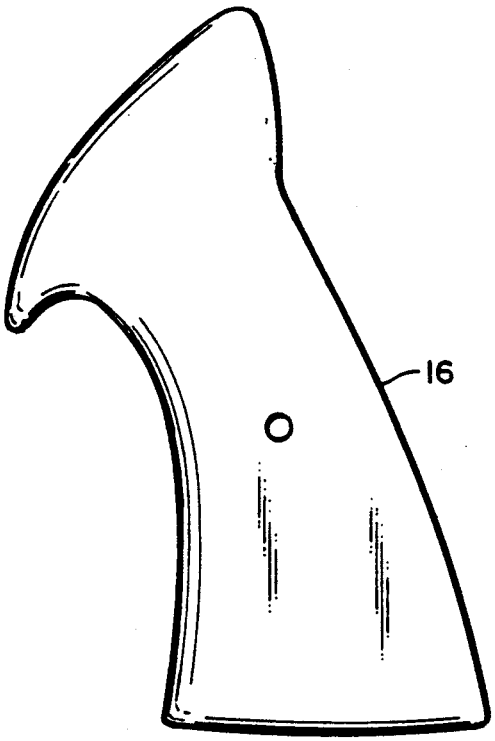
FIG. 3 is a side elevational view of one of two clam shell shaped portions of the hand grip.
Figure 4:
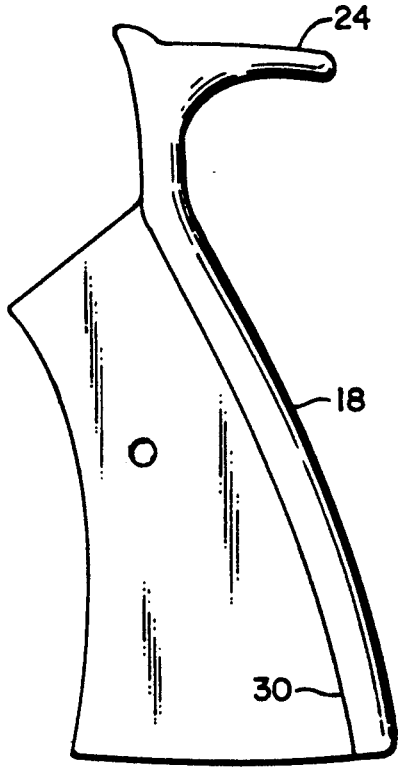
FIG. 4 is a side elevational view of another of the two clam shell shaped portions of the hand grip.

Referring now to FIGS. 1, 3, 4 5 and 6 there is shown a revolver 10 on which is installed a hand grip 12 in accordance with one form of the invention. The revolver 10 includes a conventional frame 14 to which the hand grip 12 is attached.

The revolver also includes an action that includes a cylinder 2, trigger 4 and hammer 6.

Figure 5:
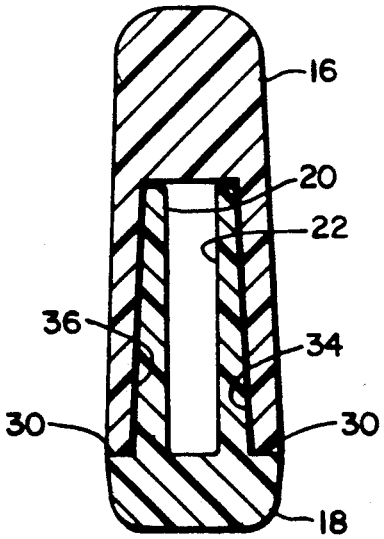
FIG. 5 is a sectional view to an enlarged scale taken along the line 5—5 of FIG. 1.

The hand grip 12 includes two clam shell shaped portions 16, 18. The clam shell portions are disposed in snug fitting nested relationship. As best seen in FIG. 5 the portion 18 includes two generally planar web sections 20, 22. The respective interior faces of the web sections 20, 22 snugly engage the opposed faces of the frame (not shown in FIG. 5). The portion 18 also includes a beaver tail shaped tang 24. It will be seen that the tang 24 is supported by a substantial structure. Thus, the tang 24 is able to absorb the very substantial forces transmitted from the revolver 10 through the tang 24 to the hand of the user of the revolver 10.

The portion 18 is also characterized by generally planar outer faces of the web shaped sections 20, 22 that cooperate with the clam shell shaped portion 16. The portion 18 also includes lips 30, 30 that cooperate with the portion 16.

The clam shell shaped portion 16 has two generally planar interior surfaces 34, 36 that are dimensioned and configured to engage the outer faces of the web shaped sections 20, 22. As best seen in FIG. 5 the respective clam shell shaped sections of the portion 16 butt up against the respective lips 30, 30 of the portion 18.

Figure 6:
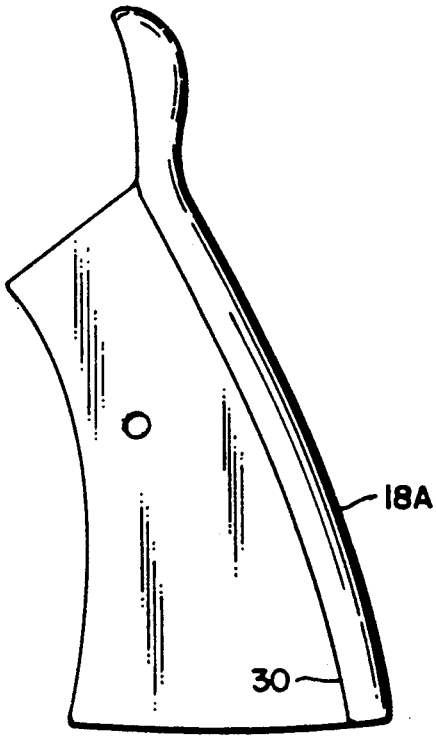
FIG. 6 is a side elevational view of an alternate embodiment of the second of the two clam shell shaped portions of the hand grip.

As best shown in FIG. 6 an alternate clam shell shaped portion 18A may be substituted for the portion 18. The portion 18A is substantially the same as the portion 18 except for the elimination of the tang 24. The portion 18 is particularly useful for target shooting and rapid fire situations. The portion 18A is particularly advantageous for situations where a fast draw is required. More particularly, the absence of the tang 24 will minimize the risk of catching on the clothing. Advantageously, the revolver 10 will be equipped with all three portions 16, 18, and 18A. Thus, the user may easily interchange portions 18 and 18A by removing a screw 40 and slipping the one portion off the frame 14 and installing the other portion on the frame 14.

It will thus be seen that the user can enjoy the advantages of the beaver tail tang 24 to absorb the recoil of the revolver and yet can easily substitute an alternate construction when the same revolver is to be used in a manner that demands the ability to draw the weapon quickly. It will also be seen that the use of the clam shell shape not only provides a sturdy support for the tang 24 but also enables the substitution of only a single piece to add or remove the tang 24.

The hand grip 12 may be manufactured out of plastic or other materials that have been used to manufacture such hand grips.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A hand grip apparatus for an associated revolver which comprises:

first and second clam shell shaped portions; said first and second clam shell shaped portions are disposed in nested relationship, one of said portions including a tang dimensioned and configured to engage the hand of the user at the web intermediate the thumb and forefinger and further including a third clam shell portion that is substantially the same as said one portion except that said third portion does not include a tang.

2. A hand grip apparatus for an associated revolver which comprises:

first and second clam shell shaped portions, each of said portions having inner and outer portions, said first portion having respective first and second generally planar outer faces which respectively extend over the majority of the respective areas of the outer surfaces thereof and said second portion having first and second generally planar inner faces which respectively extend over the majority of the respective inner surfaces, said first and second outer faces being disposed respectively with the majority of the surface area thereof in face to face abutting relationship with the majority of the surface area of said first and second inner faces.

3. The apparatus as described in claim 2 wherein:

said first and second clam shell shaped portions are disposed in nested relationship.

4. The apparatus as described in claim 3 wherein:

one of said portions includes a tang dimensioned and configured to engage the hand of the user at the web intermediate the thumb and forefinger.

5. The apparatus as described in claim 4 further including:

a third clam shell portion that is substantially the same as said one portion except that said third portion does not include a tang, said third portion intended for alternative utilization instead of said one portion.

6. The apparatus as described in claim 5 wherein:

one of said portions includes a lip against which the other butts against.

7. A revolver apparatus which comprises:

a frame;

an action;

a hand grip including first and second clam shell shaped portions, said first and second clam shell shaped portions are disposed in nested relationship, one of said portions including a tang dimensioned and configured to engage the hand of the user at the web intermediate the thumb and forefinger; and a third clam shell portion that is substantially the same as said one portion except that said third portion does not include a tang.

* * * * *